United States Patent [19]

Lynch

[11] 4,049,040

[45] Sept. 20, 1977

[54] SQUEEZE CASTING APPARATUS AND METHOD

[75] Inventor: Richard F. Lynch, Toledo, Ohio

[73] Assignee: N L Industries, Inc., New York, N.Y.

[21] Appl. No.: 602,687

[22] Filed: Aug. 7, 1975

[51] Int. Cl.[2] ..... B22D 27/12

[52] U.S. Cl. ..... 164/120; 164/131; 164/321; 164/347

[58] Field of Search ..... 164/120, 284, 319, 320, 164/321, 131, 347

[56] References Cited

U.S. PATENT DOCUMENTS

| | | | |
|---|---|---|---|
| 1,697,741 | 1/1929 | Vaughan | 164/321 |
| 2,181,157 | 11/1939 | Smith | 164/120 X |
| 3,106,002 | 10/1963 | Bauer | 164/120 |
| 3,120,038 | 2/1964 | Lauth | 164/320 |
| 3,534,802 | 10/1970 | Carr | 164/120 |

FOREIGN PATENT DOCUMENTS

| | | | |
|---|---|---|---|
| 167,657 | 2/1951 | Austria | 164/319 |
| 474,980 | 7/1951 | Canada | 164/120 |
| 214,042 | 5/1968 | U.S.S.R. | 164/120 |
| 240,953 | 8/1969 | U.S.S.R. | 164/120 |

*Primary Examiner*—Robert D. Baldwin

*Attorney, Agent, or Firm*—Richard D. Emch

[57] ABSTRACT

An improved method of and apparatus for pressure casting metal are disclosed. The method is generally known in the art as "squeeze casting". The present method provides for casting articles under forging pressures in a die to predetermined dimensions regardless of varying amounts of excess of poured molten metal, by the inclusion of a retractable charge-quantity compensator positioned adjacent the casting cavity to form on the cast article an extension which may vary in volume from article to article. The extension is later removed. The charge-quantity compensator may be in the form of a piston in a cylinder with hydraulic fluid behind the piston connected to a hydraulic source. The piston, which may be normally biased toward the die cavity but yieldable away therefrom is fixed in position when the punch die has advanced to a predetermined position at which the quantity of casting material in the die cavity is appropriate for the article being formed. Full casting pressure is then applied. Multiple part casting dies may be used wherein multiple punch dies are connected to a common pressing head since variations in quantities of poured casting material are taken by the separate compensators associated with each of the die cavities.

12 Claims, 5 Drawing Figures

SQUEEZE CASTING APPARATUS AND METHOD

BACKGROUND OF THE INVENTION

The invention relates to squeeze casting or forming a metal article from a molten charge under pressure, and more particularly to an improved squeeze casting apparatus and method wherein articles of predetermined and uniform dimensions may be produced even though quantities of poured molten casting material may vary from cycle to cycle.

Squeeze casting, or forming metal articles in a die under high pressure during solidification, has been known for some years. See, for example, U.S. Pat. Nos. 3,228,073 and 3,613,768 which show various forms and aspects of squeeze casting. Parts produceable by squeeze casting have been otherwise produced by either conventional casting or forging methods or by machining.

In squeeze casting, the molten casting material is subjected to a high pressure, usually 4000 to 20,000 p.s.i., by the action of a two-piece die mounted on a hydraulic press. A "punch" or upper die piece moves into and seals with a precisely finished female die cavity that forms the outside of the part and initially receives the charge of molten material. Upon closing, the punch die and the female die define a closed die cavity space which is completely filled with the molten material by displacement due to the continued advancement of the punch die. The desired pressure is then exerted on the punch die and on the material within the die cavity and continues while the cast article solidifies. The result is a high density, porosity free article having a fine grained microstructure and a good surface finish. The squeeze cast article has properties comparable to forgings but at casting costs. In fact, the strength properties of squeeze cast articles generally equal or exceed those of articles wrought or forged from the same alloy. The process is adaptable to both ferrous and nonferrous alloys.

There are two variations of squeeze casting. In one, solid parts are produced simply by utilizing solidification under pressure. An important consideration with this variation is the casting's height-to-diameter ratio, which should be below a certain maximum for effective squeeze casting. The other variation may be described as molten metal extrusion, whereby hollow parts are produced. As discussed above, molten metal is forced upward as the punch die descends, until the volume of the closed cavity matches that of the poured metal. At this time, full pressure is applied to the solidifying metal with a hydraulic shock. With both variants there is a beneficial fine grained microstructure obtained because of the rapid rate of solidification achieved.

Certain shortcomings of squeeze casting as heretofore known have resulted from the fact that precise control could not be maintained over the quantity of poured metal admitted to the squeeze casting die in each operation. This imprecision dictates that squeeze casting can be used only when certain dimensions of a component are not critical or when extensive machining of the cast part can be accepted. It also prevents the use of a single press head affixed to a plurality of punch dies coacting with respective female dies, since squeeze casting pressure cannot be maintained on such plural castings without exactly corresponding quantities of poured metal in each of the squeeze casting cavities. If one cavity closes on its charge of molten metal and reaches the desired pressure before the remaining cavities, it will obviously be the only cavity to reach and maintain the desired pressure, and only one properly squeeze cast article will result.

Partial solutions to these problems have been suggested, and in some cases used. When an outside height dimension on a squeeze cast component is critical, a way to circumvent the problem of charge variations has been to locate the dimension which is subject to variation on the inside surface of the component. To this end, a "telescoping" punch die may be utilized. Such a punch die includes a flange which actually comes to rest against the lower die before pressure is applied. A telescoping portion of the punch is retractable into the punch, and when the punch has come to rest against the lower die, pressure is applied by forcing the telescoping portion toward the cavity. Since charge quantities are not precisely consistent, the telescoping portion leaves a variable dimension which should be located in an area where dimensions are not critical. The remaining dimensions of the component are of course controlled by the fixed dimensions of the cavity resulting from the fact that the punch die rests against the lower die and does not itself provide casting pressure. In this sense, use of such a casting apparatus more closely approximates die casting than squeeze casting, with attendant disadvantages. Other limitations of this type casting apparatus are that it cannot be used when every dimension of a component is critical, and that the telescoping punch tends to localize casting pressure in the area of the telescoping portion as stiffening occurs.

U.S. Pat. Nos. 3,068,539, 3,120,038 and 3,387,646 show casting or molding processes somewhat similar to squeeze casting. In these patents a central die similar to a punch die is lowered into a cavity containing poured molten casting material, which rises to fill the resulting cavity as the punch die continues downward. However, as in the above described telescoping punch apparatus, casting pressure is not obtained by the force of this central die against the body of casting material, since the movable central die hits a rigid stop to limit its downward motion. During the final portion of the travel of the central die, excess casting material is forced out of a narrow, restricted annular passageway around the top of the cavity defining the article to be formed. An excess charge is thus compensated for in this way. At this point, the molten casting material has been subjected to only a low pressure. After the metal has partially solidified, pressure pins at the bottom or sides of the die cavity are forced inwardly toward the die cavity to compensate for shrinkage of the molten metal which takes place as the metal solidifies. It is stated that since the metal in the narrow, restricted overflow passage has already solidified before the pressure pins are moved inwardly, the movement of the pins does not cause further displacement of the metal through the passage.

Although the above patents disclose a means for controlling the dimensions of a cast component, the process is very different from squeeze casting and from the present invention in that pressure on the cast component is exerted only after the metal has partially solidified, and it is introduced into a localized area. Thus, the properties of the resulting cast component are generally inferior to those of squeeze casting since metal flow throughout the entire part is not as effectively controlled during solidification. Compensation for charge size variation is achieved not by the pressure pins, but by the overflow of molten material which forms a large, uneven ring of flash on the cast article. Effective, efficient dimensional control in combination with the benefits of squeeze casting are thus not provided by the apparatus and method of the above patents, as they are by the present invention described below.

SUMMARY OF THE INVENTION

The present invention is an apparatus and method for maintaining precise control over all of the dimensions of a squeeze cast article. The invention enables multiple squeeze casting punch dies to be connected together and operated by a common press, despite variations in the quantities of molten metal poured into the multiple die cavities.

By apparatus according to the invention, excess metal within the cavity is forced into an extension of the cavity, where it forms a compact appendage which can later be removed. A charge-quantity compensating hydraulic piston and cylinder are provided in immediate communication with the die cavity, preferably in the central bottom of the cavity. During lowering of the punch die into the female die, a bias pressure urging the compensating hydraulic cylinder toward the die cavity is overridden by pressure applied directly to the metal by the punch die, thus allowing excess metal to move into the compensating cylinder to form an appendage of the component which grows until the predetermined component height is reached in the main die cavity. At this point, a signal originating from a sensing means connected to the punch die causes the piston within the compensating hydraulic cylinder to be locked in place. This may be accomplished by closing a fluid valve leading to the compensating hydraulic cylinder. After the piston has become rigidly fixed, full squeeze casting pressure is applied through the punch die. In a series of squeeze casting operations in a given die, varying lengths of excess metal appendages will be formed on the series of components. These appendages are later removed by conventional steps to form a series of uniformly dimensioned components.

Since the invention compensates for variations in quantities of excess metal poured into the female squeeze casting die, it also facilitates the use of multiple squeeze casting operations wherein a plurality of punch dies are connected for movement together and engaged by a common pressing head. In such multiple component squeeze casting, the pistons of the compensating cylinders are all fixed simultaneously, but each may be in a different position within its respective cylinder due to the varying amounts of metal poured for each squeeze casting.

Although the preferred position of the charge quantity compensating cylinder is in the female die cavity, it may also be located in the punch die itself, thus forming the overpour appendage in a different location.

The charge quantity compensating piston and cylinder of the invention may also be used advantageously for an additional purpose. Pressure may be applied behind the piston during the application of casting pressure and solidification in cases where the local area around the cylinder may need extra pressure. For example, if a heavy wall section is located in the vicinity of the cylinder, the compensating piston, after it has been locked in position momentarily, may be pushed inward during solidification to insure that the heavy wall section is porosity-free in the final component. In this use, the compensating piston acts similarly to the pressure pins of the above discussed U.S. Pat. Nos. 3,068,539, 3,120,038 and 3,387,646.

DESCRIPTION OF THE PREFERRED EMBODIMENTS

Figure 1:
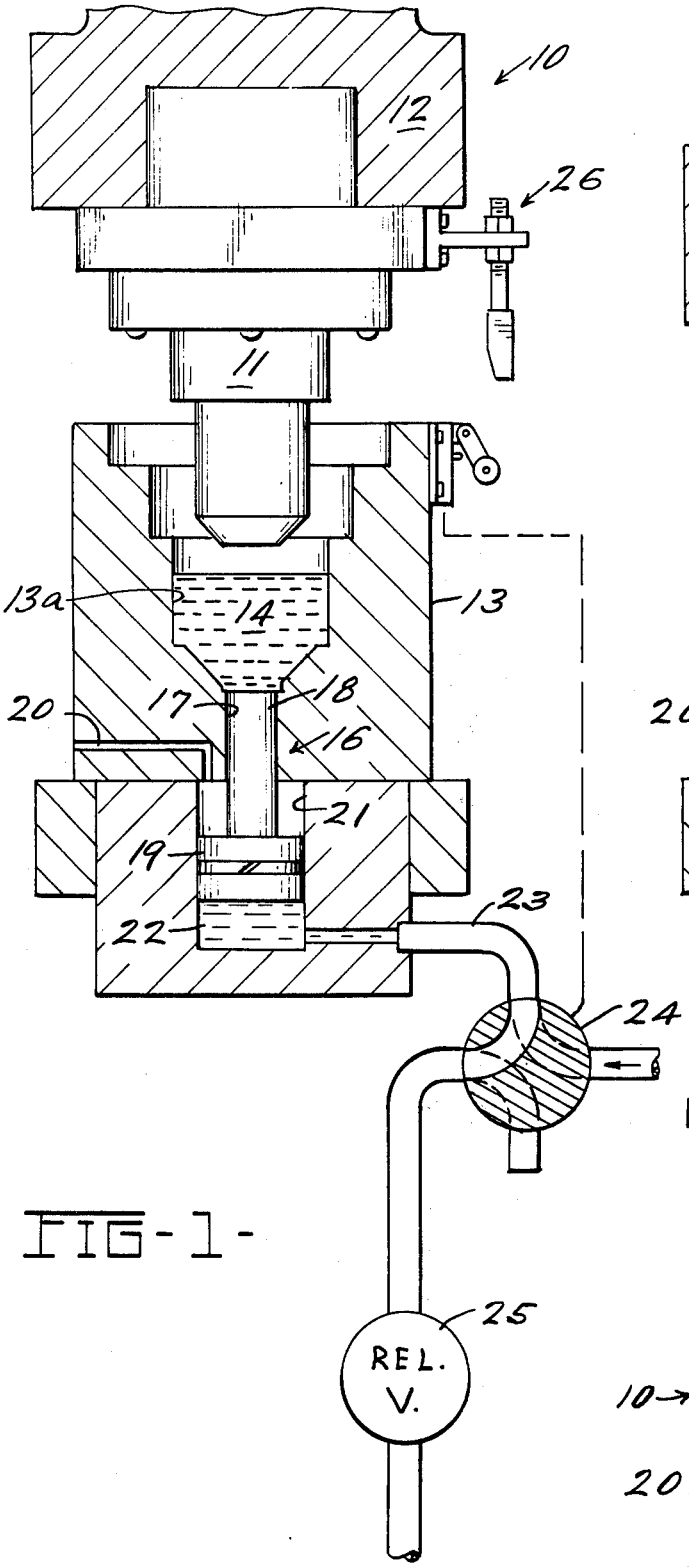
FIG. 1 is a sectional view of a squeeze casting apparatus according to the invention, shown in the open position with a charge of molten casting material in place in the female die cavity.

In the drawings, FIG. 1 shows a squeeze casting apparatus according to the invention generally indicated by the reference number 10. The apparatus 10 includes a punch or upper die piece 11 shown in a raised position and connected to a press head 12 of a preferably hydraulic press, and a female die 13 containing a charge 14 of molten casting material which is somewhat oversized for the article to be formed. The squeeze casting apparatus 10 also includes a charge-quantity compensator generally indicated by the reference number 16. The compensator 16 consists of a bore 17 leading downwardly from a cavity **13*a* defined by the female die 13, with a slidable piston 18 sealingly fitted therein. The cylinder 17 and piston 18 may be of any cross sectional area. The piston 18 is adapted to retract downwardly when the liquid casting material 14 is sufficiently pressurized. Although the piston 18 and cylinder 17 are preferably located as shown, they may also be advantageously located in the punch die 11.** The location of the piston and cylinder depend upon the shape of the component to be formed.

At the lower end of the piston 18 is a second, larger piston 19 within a hydraulic cylinder 21 which is aligned with the cylinder 17 above. An air vent 20 may be provided for maintaining atmospheric pressure in the cylinder 21 above the piston 19. Although hydraulic fluid 22 within the cylinder 21 could alternatively be made to act directly on the smaller piston 18, the larger piston 19 is provided so that the pressure required to be exerted on the fluid 22 is lowered somewhat. The hydraulic cylinder 22 may be connected to a line 23 leading to a source of hydraulic pressure (not shown), depending upon the position of a fluid valve 24 within the line 23, which may be a three-position valve as shown. In FIG. 1 the valve 24 is shown connecting the line 23 to a relief valve 25, the function of which will be explained below. Below the relief valve 25 is a fluid sump (not shown) suitably connected to the hydraulic source. Means can be employed for establishing the "zero" position shown in FIG. 1 for the piston 18, such as a metering device (not shown) at the hydraulic source, or other mechanical or hydraulic sensing means (not shown) capable of determining the position of the pistons 18 and 19 and feeding this information to the hydraulic source mechanically or electrically. For this operation the three-position valve 24 would be in a position rotated 90° clockwise from the position shown in FIG. 1, as indicated by dashed lines.

The squeeze casting apparatus 10 also includes a means 26 for determining the relative positions of the punch die 11 and the female die 13. The operation of the position determining means 26, which may employ a limit switch as shown, will be explained below.

Figure 2:
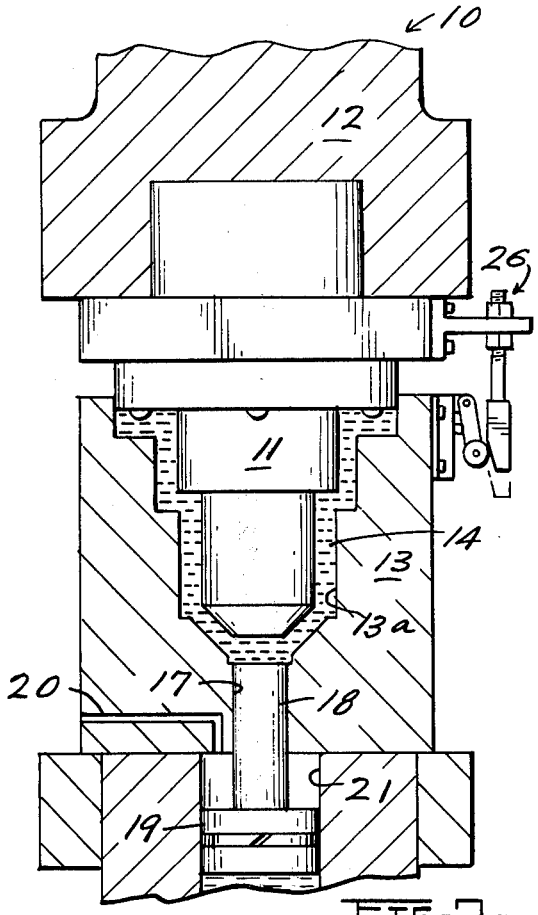
FIG. 2 is a sectional view of the apparatus of FIG. 1 showing the punch die as it just closes upon the body of molten casting material to fill the cavity between the two die pieces.

FIG. 2 shows the apparatus 10 in a position wherein the punch die 11 has closed and sealed with the female die cavity 13*a* and has been lowered to the extent that the liquid casting material 14 has risen up to completely fill the cavity 13*a*. However, the body of casting material 14 does not yet form the finished dimensions of the article to be cast. As stated above, the volume of casting material 14 is somewhat in excess of that required for casting the article. In the position of FIG. 2 the piston 18 remains in the same position as that of FIG. 1 and the punch die 11 has not yet completed its downward stroke.

Figure 3:
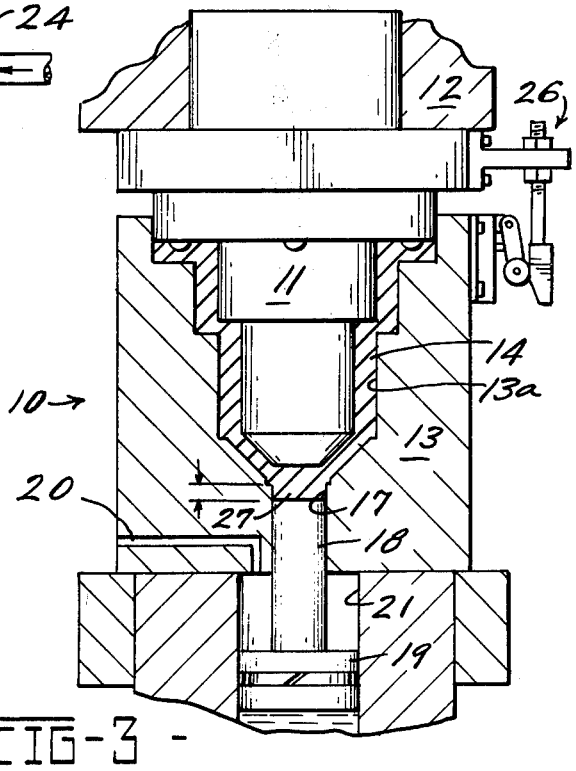
FIG. 3 is a sectional view of the apparatus showing the punch die in position for the application of full squeeze casting pressure, with the charge-quantity compensating piston in a position to be locked in place against further movement.

FIG. 3 shows the apparatus 10 with the punch die 11 fully lowered into the die cavity 13*a*. In order to proceed downwardly from the position of FIG. 2 to this position, the punch die 11 displaces an appropriate portion of casting material 14, equivalent to the excess amount of casting material present, downwardly into the cylinder 17, thereby displacing the compensator piston 18. The bias or resisting force behind the piston 18, maintained by the hydraulic fluid 22 behind the larger piston 19, is somewhat less than that required to withstand full casting pressure on the molten casting material 14. In the embodiment shown in FIG. 1, the relief valve 25 provides this resistance, being set to pass hydraulic fluid only when pressure on the charge 14 is almost up to casting pressure. Thus, as the punch die 11 is further lowered by the press head 12 beyond the position of FIG. 2, sufficient pressure builds up in the casting material 14 to override the force acting upon the compensator piston 18, and the piston 18 retracts to form an appendage 27 on the body of casting material. This appendage 27 continues to grow as the punch die 11 is lowered, until the fully lowered position of FIG. 3 is reached, at which time the body of casting material 14 is appropriately sized. At this point, the position sensing apparatus 26 determines that the punch die 11 has reached the proper position and sends a signal effective to close the fluid valve 24 in the line 23 shown in FIG. 1. For the three-position valve 24 shown in FIG. 1, the closed position is 90° counterclockwise (dashed lines) from the position shown in solid lines. Since the hydraulic fluid 22 within the cylinder 21 is a substantially incompressible fluid, the closure of the valve 24 locks the piston 19, and therefore the piston 18, in the position shown in FIG. 3. Under the force of the pressing head 12, full squeeze casting pressure then builds up in the body of casting material 14 and is maintained during solidification and shrinkage of the resulting squeeze cast article.

As discussed above, the piston 18 can be used to apply an additional localized pressure to the molten charge during solidification, to insure a lack of porosity in the component adjacent the piston. Such a localized pressure would be greater than that applied by the punch die on the molten charge, but it would not force the punch die to retract since it would be delayed until the charge has partially solidifed. For application of such local pressure by the piston 18, the three-position valve 24 of FIG. 1 may be moved to the piston connecting the hydraulic cylinder 22 with the pressure source following a momentary period wherein the piston is locked, and a high pressure may be applied to push upwardly on the piston 18. Alternatively, the valve 24 may be moved to the pressure-source connecting position immediately when the punch die has reached the proper position, and source pressure may be regulated and timed appropriately to assure correct dimension of the component and the proper application of local pressure during solidification.

When the squeeze cast article has been formed and the punch die 11 has been removed from the female die 13, the article can be ejected from the die cavity 13*a* by positioning of the valve 24 to connect the line 23 with the hydraulic source (90° rotated clockwise from the position shown in solid lines in FIG. 1) and the application of pressure to the hydraulic fluid 22 to raise the pistons 19 and 18. This can be accomplished as the piston 18 is returned to the position shown in FIG. 1 in preparation for the succeeding squeeze casting cycle, or by a longer stroke wherein the piston 19 is raised to the top of the cylinder 21. The "zero" position of the piston 18 can be regained by action of the hydraulic source (not shown), as discussed above.

When the squeeze cast article has been ejected and removed from the female die 13, the appendage 27, the length of which will vary from article to article, can be removed by machining operations and salvaged for remelting.

Figure 4:
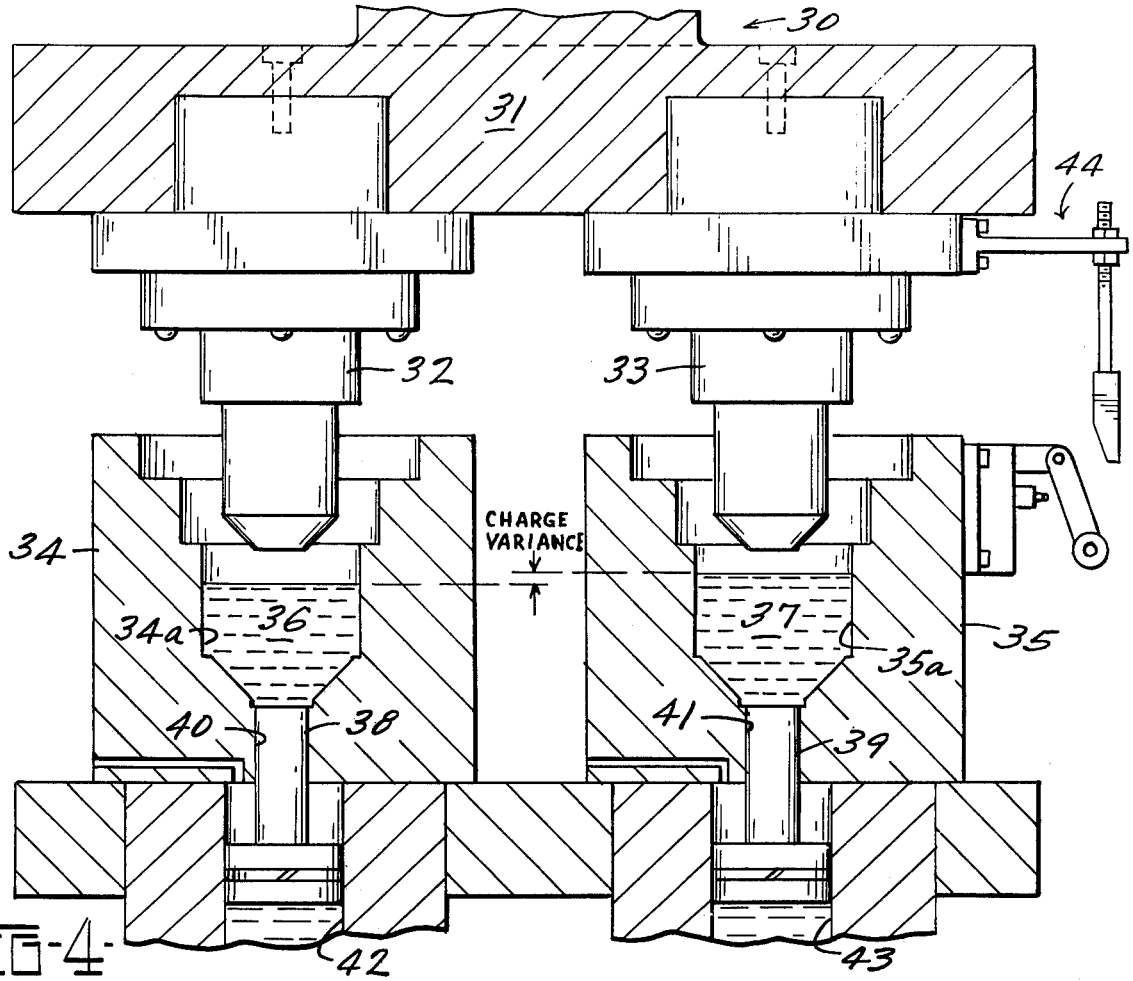
FIG. 4 is a sectional view showing a plurality of squeeze casting apparatus according to the invention with the plural punch dies of the apparatus connected together for engagement by a common pressing head.
Figure 5:
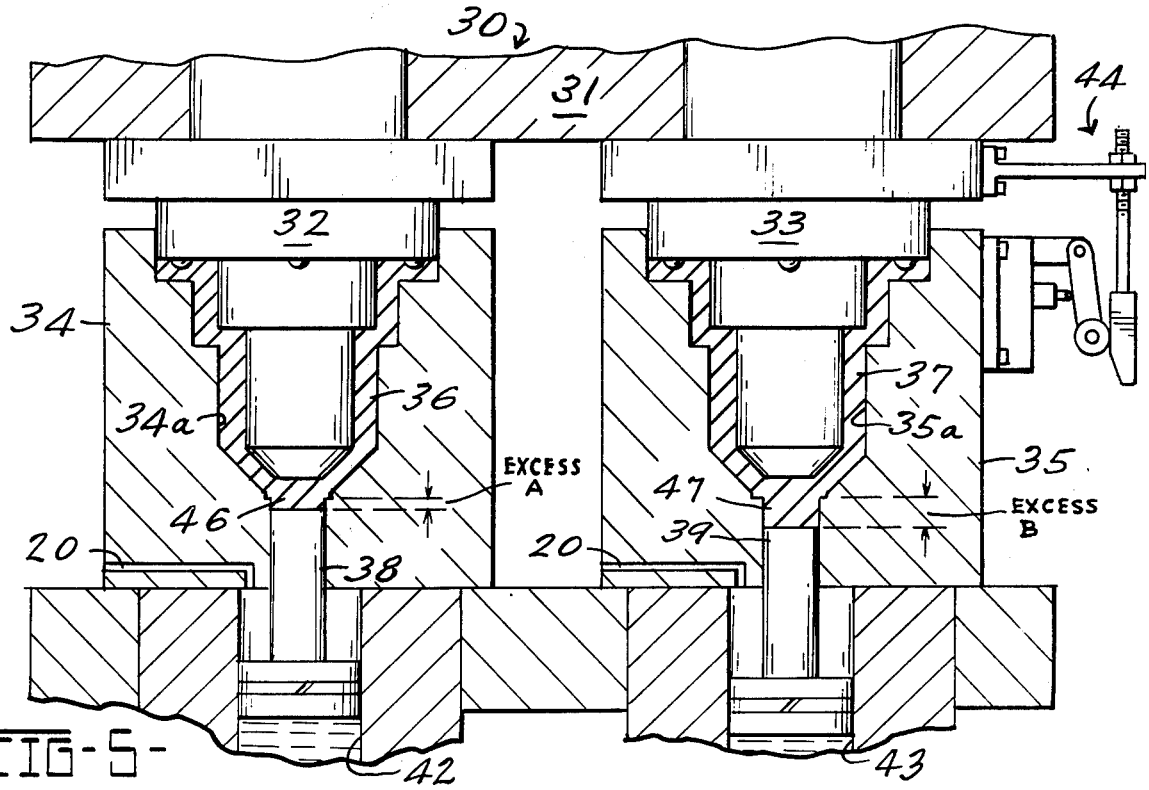
FIG. 5 is a sectional view similar to FIG. 4 showing the plural punch dies in position for the application of full squeeze casting pressure.

FIGS. 4 and 5 illustrate how the apparatus of the invention can be utilized to simultaneously produce multiple squeeze cast articles with the utilization of a single press and pressing head connected to a plurality of punch dies. Apparatus 30 according to the invention includes a pressing head 31 connected to punch dies 32 and 33. Only two punch dies are illustrated, but a larger number can be connected to the same pressing head 31. Corresponding female dies 34 and 35 are positioned for interaction with the punch dies 32 and 33. As FIG. 4 indicates, the sizes of casting material charges 36 and 37 in die cavities 34*a* and 35*a* are not the same, since conventional ladling or molten material feeding methods cannot be depended upon to add the exact same volume of molten casting material to each of the female dies. The dies 34 and 35 include charge-quantity compensating pistons 38 and 39 within sealingly fitted cylinders 40 and 41, respectively, as in the above embodiment. The pistons 38 and 39 may be served by hydraulic cylinders 42 and 43 having separate selective valves for connecting them to a source of hydraulic pressure (not shown), for connecting them to a sump through relief valves, or for closing them against outflow of hydraulic fluid, as described above in connection with the first embodiment. The female die pieces 34 and 35 are of course evenly positioned, as are the punch dies 32 and 33, so that the position of each die within its corresponding die cavity as nearly as possible corresponds to that of the other at all times. A position sensing device 44 determines when both punch dies have reached the appropriate position within the corresponding die cavities.

FIG. 5 shows the punch dies 32 and 33 in the appropriate full downward position preparatory to the application of full squeeze casting pressure. As indicated, the compensator pistons 38 and 39 have been displaced downwardly to different extents, due to the different sizes of the charges 36 and 37 of molten casting material within the die cavities 34*a* and 35*a*, respectively. Each body 36 or 37 of casting material, however, is appropriately sized for the squeeze casting of a pair of articles of identical predetermined dimension, except for the length of excess material appendages 46 and 47.

In the position of FIG. 5, the position sensing device 44 sends a signal which is effective to lock the compensator pistons 38 and 39 in position, by closure of the hydraulic valves discussed above to prevent further outflow of fluid from the hydraulic cylinders 42 and 43. Full squeeze casting pressure is then applied by the press head 30 and maintained during solidification and shrinkage of the resulting cast articles. As in the first embodiment, once the press head and punch dies 32 and 33 have been retracted, the squeeze cast article can be ejected by return of the compensator pistons 38 and 39. The variably sized appendages 46 and 47 can then be trimmed off as described above.

Although the embodiments of the invention described herein illustrate the use of hydraulic means to provide a resisting force on the compensator pistons, and the use of valves to stop hydraulic fluid flow and lock the compensator pistons in position, it should be understood that mechanical substitutions can be made for the hydraulic means. For example, a compression spring (not shown) may be employed to bias the compensator pistons upwardly, with a mechanical braking means (not shown) utilized to lock the pistons in position.

The above described preferred embodiments provide significant improvements in both method and apparatus for squeeze casting an article. The invention facilitates the achievement of precisely dimensioned squeeze cast articles in a series of squeeze casting cycles, as well as the use of multiple, commonly connected punch dies to cooperate with respective die cavities to produce precisely formed multiple squeeze cast articles, regardless of deviations in the volumes of respective charges of casting material. Various other embodiments and alterations to these preferred embodiments will be apparent to those skilled in the art and may be made without departing from the spirit and scope of the following claims.

I claim:

1. A method of casting a metal article, comprising:

placing a quantity of molten metal into an open-topped female die, such quantity being in excess of the quantity required for the article;

lowering a sealingly fitted punch die into the female die until the molten material fills the resulting closed die cavity;

continuing to lower the punch die until a predetermined punch position is reached, while forming a die extension and displacing excess metal into the die extension from the closed die cavity;

terminating die extension formation and the displacement of metal from the die cavity when the predetermined punch position is reached;

applying a continuous high pressing force on the punch die until the metal has solidified; and retracting the punch die.

2. The method of claim 1 wherein said die extension forming step comprises the yielding of at least one wall portion of the die cavity to form an appendage of excess casting material on the article.

3. In a squeeze casting apparatus including a female die half for receiving a quantity of molten casting material, a movable punch die adapted to be moved a fixed distance into the female die half and closed in sealing engagement therewith to form a closed die cavity, and means for applying a high pressing force on the punch die toward the female die half, the improvement comprising:

die extension means adjacent the die cavity and adapted to be formed as the punch die moves into the female die and compresses the molten material;

means for sensing the advancement of the punch die to a predetermined position short of said fixed distance in the female die; and means for terminating formation of said die extension means in response to a signal from said sensing means;

whereby said pressing force may continue to be exerted on the punch die and the molten casting material within the die cavity to form an article of predetermined dimensions.

4. The apparatus of claim 3 wherein said die extension means comprises a retractable piston-like charge-quantity compensator sealingly positioned within a bore extending from the die cavity in a direction parallel to the path of movement of the movable punch die, including means normally providing a resistance against movement of the compensator away from the die cavity and means for holding the compensator stationary in response to a signal from the sensing means, until the article has been formed.

5. The apparatus of claim 4 wherein said charge-quantity compensator also includes means for forcing the compensator toward the die cavity during solidification of the molten material, to apply an additional localized pressure to the solidifying article.

6. The apparatus of claim 4 wherein said charge-quantity compensator and bore are in communication with the female die half.

7. The apparatus of claim 6 wherein said charge-quantity compensator also includes means for forcing the compensator toward the die cavity after the article has been formed and the punch die has been retracted, to eject the article from the female die.

8. The apparatus of claim 7 wherein said means providing a resistance, said holding means and said forcing means are hydraulic.

9. A squeeze casting apparatus according to claim 3, including a plurality of female die halves and a like plurality of punch dies, said punch dies being connected together for simultaneous movement, and wherein said pressing means simultaneously applies a pressing force on each of said punch dies toward its respective female die half.

10. In a squeeze casting apparatus including a female die half for receiving a quantity of molten casting material, a movable punch die adapted to be moved a fixed distance into the female die half and closed in sealing engagement therewith to form a closed die cavity, and means for applying a pressing force on the punch die toward the female die half, the improvement comprising a charge-quantity compensator including a bore leading from the die cavity through a portion of the female die half and oriented parallel to the path of movement of the punch die, a piston sealingly positioned within the bore and movable from a position adjacent the inside surface of the die cavity to a position retracted outwardly therefrom, means yieldingly resisting the movement of the piston away from the die cavity, and means for holding the piston stationary in response to the advancement of the movable punch die to a predetermined position short of said fixed distance in the female die half, whereby said pressing force may continue to be exerted on the punch die.

11. The apparatus of claim 10 which further includes means for forcing the piston toward the die cavity after the article has been formed and the punch die has been retracted, to eject the article from the female die.

12. A squeeze casting apparatus according to claim 10, including a plurality of female die halves and a like plurality of punch dies, said punch dies being connected together for simultaneous movement, and wherein said pressing means simultaneously applies a pressing force on each of said punch dies toward its respective female die half.

* * * * *